United States Patent [19]

Alexander et al.

[11] Patent Number: 4,845,364

[45] Date of Patent: Jul. 4, 1989

[54] COAXIAL REENTRANT ION SOURCE FOR SURFACE MASS SPECTROSCOPY

[75] Inventors: Carl A. Alexander; Julius S. Ogden, both of Grove City; Richard A. Severance, Columbus, all of Ohio

[73] Assignee: Battelle Memorial Institute, Columbus, Ohio

[21] Appl. No.: 161,546

[22] Filed: Feb. 29, 1988

[51] Int. Cl.[4] ..... H01J 27/00; H01J 49/00

[52] U.S. Cl. ..... 250/423 R; 250/427; 250/288

[58] Field of Search ..... 250/281, 282, 283, 285, 250/287, 288 R, 423 R, 424, 427, 251; 315/111.81

[56] References Cited

U.S. PATENT DOCUMENTS

| | | | |
|---|---|---|---|
| 4,686,365 | 8/1987 | Meek et al. | 250/281 |
| 4,757,203 | 7/1988 | Gil et al. | 250/281 |
| 4,757,237 | 7/1988 | Hellblom et al. | 250/423 R |
| 4,766,320 | 8/1988 | Naitoh et al. | 250/281 |

*Primary Examiner*—Bruce C. Anderson
*Assistant Examiner*—Michael Aronoff
*Attorney, Agent, or Firm*—Klaus H. Wiesmann

[57] ABSTRACT

An improved ion source for characterization of a surface of a sample including a housing oriented about a central axis, Z; a magnet cooperatively disposed within the housing for producing a magnetic field along the Z axis direction an anode radially disposed within the housing and within the magnetic field of the magnet that defines an annular ionization chamber having an open annular space and further forming a central tubular space about the Z axis; a cathode cooperatively disposed at the anode and within the annular ionization chamber; an extractor grids means cooperatively disposed within the housing so as to form a boundary of the ionization chamber; annular focusing rings disposed on the housing and externally to the extractor grids for focusing ions emerging therefrom; neutralizer filament cooperatively disposed with focusing rings; a central lens cooperatively disposed about the central axis Z in the central tubular space formed by the anode and adapted to accept ions and neutrals emanating from a sample; an entrance grid disposed at the sample end of the central lens; a second ionizer disposed along the length of the central lens; an exit grid for directing ions toward a measurement instrument such as a mass spectrometer; and an input gas pipe cooperatively disposed with the housing and anode so as to supply gas to the ionization chamber. A shield is preferably used to shield the apparatus from electromagnetic interference.

4 Claims, 4 Drawing Sheets

COAXIAL REENTRANT ION SOURCE FOR SURFACE MASS SPECTROSCOPY

FIELD OF THE INVENTION

This invention relates to an ion source for a mass spectrometer. The ion source utilizes a focused primary beam of ions that in turn liberate secondary ions and neutrals that are characteristic of the surface of the target sample. A cylindrical lens in the center of the ion source accepts a portion of the liberated ions and neutrals. By means of a grid, and applied potential, the neutrals and secondary ions can be separately introduced through the lens into a mass spectrometer.

BACKGROUND OF THE INVENTION

Characterization of surfaces by secondary ion analysis has been an established analytical procedure for more than 20 years [H. J. Liebl, R. F. K. Herzog, Journal of Applied Physics, 34, 2893 (1963) and J. V. P. Long, British Journal of Applied Physics, 16, 1277 (1965)]. Commercial instruments became available in the early 1970's. A typical example of which is the CAMECA-300 (G. Slodzian, Am. Phys., 9. 591 (1964)). The technique shows good sensitivity but not good quantitation. For example, secondary ion sputtering yields vary considerably from element to element, and matrix effects are pronounced and not readily calculable [C. A. Anderson, International Journal Mass Spectroscopy and Ion Physics, 2, 61, (1969) and B. F. Phillips, Journal Vacuum Science and Technology II, 1093 (1974)]. The yield of sputtered neutrals varies considerably less from element to element than secondary ions [Vossen and Kern, Thin Film Processes, Academic Table I, page 15]. A technique to ionize the sputtered neutrals in a systematic manner could lead to an analytical instrument of significant value in quantitative surface analysis. H. Ochsner, W. Gerhard, Physics Letters, 40A, 211 (1972), has shown one approach in which the sample is immersed in a chamber in which a low pressure plasma is generated by a high frequency applied field. The low pressure plasma simultaneously sputters and ionizes the components of the surfaces. An extraction lens system extracts the ions from the plasma for subsequent mass spectrometric analysis. H. Ochsner, Fourth Proceedings of Secondary Ion Mass Spectrometry, Springer, N.Y., 291 (1984), has shown much improved quantitation as compared to analysis of secondary ions alone. A commercial instrument based on Ochsner's work has been introduced as the SNMS by Leybold as model INA3.

A somewhat different approach to evaluation of neutrals is by utilization of a glow discharge. While the energy of the ions with respect to ground potential is low in the case of the high frequency plasma sputtering, the energy of ions made in the glow discharge are typically several thousand electron volts with respect to ground potential. Such high potentials almost dictate that the mass spectrometer be a direction focusing magnetic sector mass spectrometer. A commercial spectrometer utilizing the glow discharge process is the VG9000 manufactured by Vacuum Generators.

A. Benninghoven and A. Muller, Physics Letters A40, 169 (1972), have shown that if low energy, low intensity ion beams or ion beams which have been neutralized impact a surface, then surface removal of neutral species of even labile chemicals occurs. Subsequent ionization and introduction into a mass spectrometer allows for molecular identification, and in many cases, for structural information concerning the parent molecule.

It is an object of this invention to present a single compact ionization source which simultaneously sputters a surface and accepts and conditions both the sputtered neutrals and ions for subsequent mass analysis.

A second object of this invention is the realization of a mass spectrometer system in the form of a probe assembly which can be attached directly to a chamber in which some deposition process is being performed. All of the techniques and existing instruments described above require that a specimen be brought to the instrument. Sample preparation, in some cases extensive, is necessary for all of the techniques and existing instruments. At least one embodiment of this invention described herein is suitable for direct attachment to a production chamber for in-situ analysis and production control.

A third objective is to produce an analytical system simpler and more economical to produce and market than the instruments currently available commercially.

BRIEF DESCRIPTION OF THE INVENTION

DETAILED DESCRIPTION OF THE INVENTION AND PREFERRED EMBODIMENT

This invention includes a compact ion source which comprises a state-of-the-art sputter ion source using focusing graphite grids to compensate for the gap caused by an axial lens to the mass spectrometer.

The foregoing and other advantages of the invention will become apparent from the following disclosure in which a preferred embodiment of the invention is described in detail. It is contemplated that variations in structural features and arrangements of parts may appear to the person skilled in the art, without departing from the scope or sacrificing any advantages of the invention.

Figure 1:
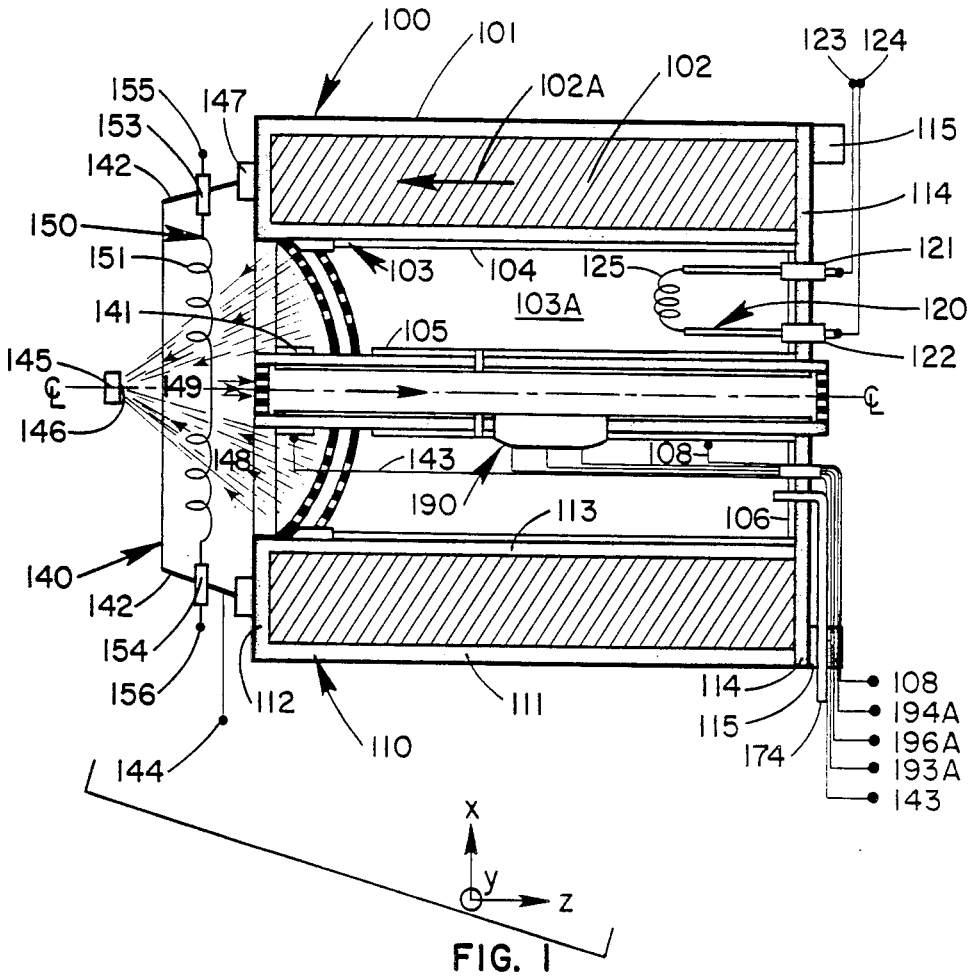
FIG. 1 depicts a cutaway side view of the apparatus of the invention.

With reference to FIG. 1 the axis direction of X, Y and Z are defined below the figure. The ion source 100 comprises a ceramic housing 110 for support and insulation of the working parts. The housing 110 comprises an outer housing wall 111, sample end housing wall 112, inner housing wall 113 and second end wall 114. Electromagnetic shield 101 covers the ion source 100 at its external surfaces and is normally at ground potential. An annular magnet 102 is cooperatively disposed within the housing 110. Magnet 102 has its field preferentially oriented in the (−) Z direction as shown by arrow 102A; however the field may be oriented in the opposite direction if desired. Magnet 102 may be a permanent magnet or an electromagnet. The main consideration is that a field of 50 to 200 gauss be generated within the ion source. An angel food cake pan shaped anode 103 is axially disposed within the housing 110. Anode 103 has outer tubular walls 104, inner tubular walls 105, and annular end wall 106 that joins walls 104, 105. Anode 103 is connected to a source of electricity by connector 108.

Cathode 120 is disposed in the annular ionization chamber 103A between walls 104, 105 of anode 103. Filament 125 of the cathode 120 is connected to a source of electricity by insulated feedthroughs 121, 122 that are supportingly disposed in anode 103 and output end wall 114. Connections 123, 124 provide connection to a source of electricity.

Disposed within the annular ionization chamber 103A formed by inner housing wall 113 and tubular lens means 170 is extraction means 130. Extraction means 130 comprises two graphite extraction grids 131, 133. Spaces within the grids 131, 133 allow passage and focusing of ions. These spaces are preferably holes of 0.01 to 0.08 inches in diameter situated to facilitate flow of ions therethrough.

Grid 131 is insulated by ceramic support 132 and not connected to any source of electrical power, it floats electrically and serves to contain the plasma and form part of the electrical potential for extraction of the primary ions. Grid 133 is connected to the shield 101 and generally is at ground potential.

Figure 2:
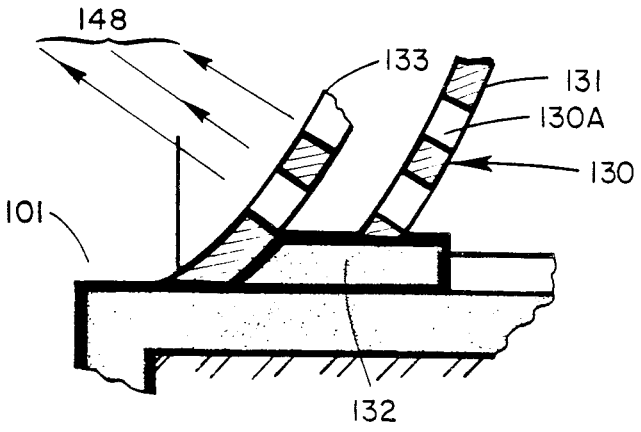
FIG. 2 depicts an enlarged section where the extraction grids join the central lens.

The extraction grids 131, 133 are shaped like umbrellas with the center lines of holes 130A oriented toward the focus 146. Prefocus is achieved in part by the umbrella shaped grids 131, 133 that produce a converging beam of ions 148 at a focus approximately 2 cm from the ion source. The positioning of grid 133 and orientation of holes 130A thereon are also adapted to prefocus the beam of ions emanating from the ionization chamber 103A. Holes 130A in extraction grids 131, 133 may be the same or of different sizes to facilitate the different functions performed by extraction grids 131, 133. Further details of grids 131, 133 are shown in FIG. 2.

A means of further focusing the ions is provided by inner focusing ring 141 disposed on ceramic tube 171 and outer focusing ring 142 disposed on ceramic insulator 147. Focusing rings 141, 142 are energized through connections 143, and 144 respectively to focus ions onto a sample 145 located at the focus 146. Neutralizing means 150 provides for a supply of electrons of about the same quantity as the positive argon ions coming from the extractor means 130, so that the net charge at the sample position 145 becomes nearly zero. If this were not done a positive charge would build up and the sputtering operation would no longer be effective due to repulsion of the argon ions. The neutralizing means comprises a filament 151 supported by feedthroughs 153, 154 and is connected to a supply of electricity by connectors 155, 156 respectively.

Disposed centrally and axially along the Z axis in the ion source 100 is a tubular lens means 170. Lens means 170 comprises a long cylindrical ceramic tube 171 having a metal tube 172 disposed therein that serves to guide the ions and neutrals formed at sample 145 to the mass spectrometer or other analysis means 203 along the +Z axis (arrow 149). Holes 173 provide for gas admission (e.g. argon) provided by gas inlet tube 174 to the lens chamber 177 of the lens means 170. Metal tube 172 surrounds lens chamber 177 and serves to form a positive lens to prevent ions colliding and sticking to the tube wall.

Figure 6:
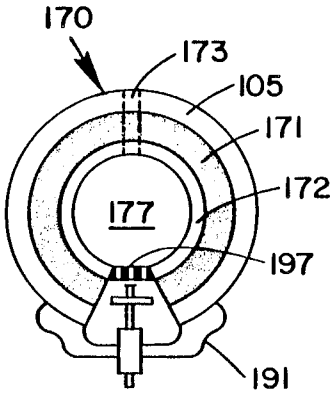
FIG. 6 depicts an axial end view of the ionizing unit of FIG. 5.
Figure 5:
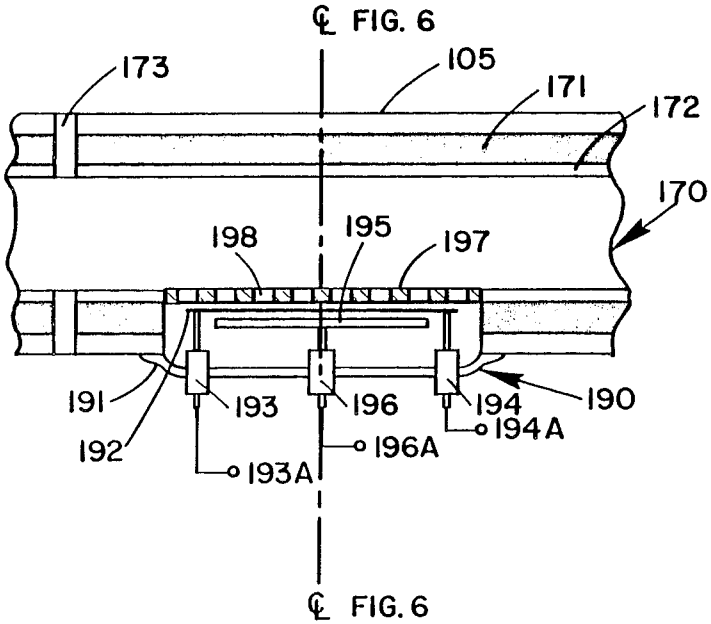
FIG. 5 depicts a cutaway side view of the ionizing unit disposed on the central lens of the invention.

At one portion of the lens means 170, the positioning of which is shown in FIGS. 5 and 6, is disposed an ionizing means 190 that functions as an ionizer of neutral atoms. The ionizing unit 190 comprises a sheld 191 disposed on inner anode wall 105, an ionizing filament 192 supported by feedthroughs 193, 194. An electron repeller 195 disposed between filament 192 and shield 191 is supported by feedthrough 196. Second entrance grid 197 is disposed between the filament and 192 lens chamber 177 enclosed by metal tube 172. Holes 198 in grid 197 allow passage of electrons into the lens chamber 177. Second entrance grid 197 is not insulated from metal tube 172. Filament 192 is energized through feedthroughs 193, 194 by connectors 193A, 194A respectively and the repeller 195 through feedthrough 196 by connector 196A.

Although FIGS. 1 and 5 show the ionizing means 190 to be relatively short compared to the total length of the tubular lens means 170, the ionizing means 190 and its associated parts preferably extend along most of the length of lens means 170. This longer length will increase the chance that the neutral atoms will be ionized as they travel through the tube 172. In a preferred embodiment ionizing means 190 is as long as possible.

Figure 3:
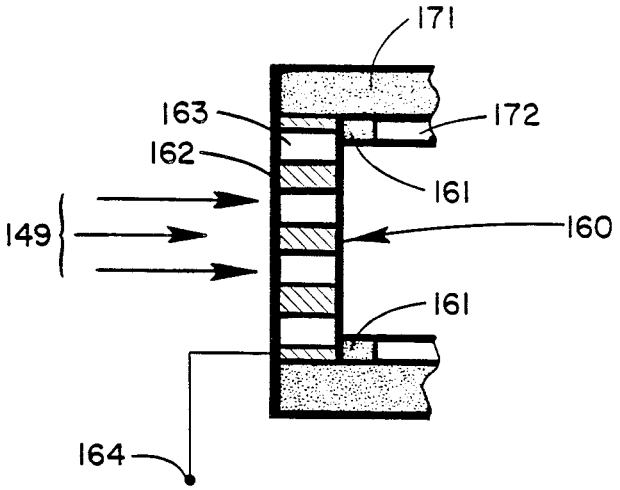
FIG. 3 depicts an enlarged section of the entrance grid at the sample end of the central lens.
Figure 4:
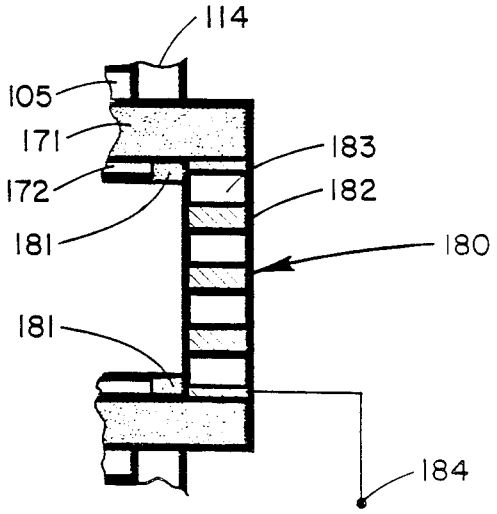
FIG. 4 depicts an enlarged section of the exit grid at the mass spectrographic (output) end of the central lens.

With reference to FIG. 3 entrance means 160 are used to control entrance of ions and electrons to the lens 170. The entrance means 160 are cooperatively disposed at the sample end of lens 170 and comprises an annular insulator 161 adjacently disposed to entrance grid 162. Holes 163 allow passage of ions and neutrals through the grid. Entrance grid 162 is energized through connector 164. Entrance grid 162 may or may not be used as further discussed below. If the grid 162 is not used the entrance means 160 defines an opening into the lens 170.

At the other end of lens means 170 is cooperatively disposed exit grid means 180. Exit grid means 180 comprises an annular insulator 181 adjacently disposed to exit grid 182. Exit grid 182 is energized through connector 184. Holes 183 provide for ion flow.

Ceramic insulator 115 serves to support and allow passage of the various connectors and gas pipe 174.

Dimensions are not critical but the device needs to be as compact as practical. A length of about 3 inches (80 mm) is a design size which affords good back ion transmission through the lens 170, and gives a reasonable L/D value for the primary ion generation system. With that scale factor for length applied to FIG. 1, the other dimensions are readily determinable. A field of 0.005 to 0.010 weber/$m^2$ from the magnet is optimum, both for the electrons emitted from the filament 125 at cathode 120, and also for the filament 192 supplying electrons for the ion lens 170 region. This magnetic field causes the electrons to follow a spiral in the X axis direction path rather than following a straight line toward the cathode in the X direction. Thus the chances of the electron encountering a gas atom and ionizing it are increased.

Pressures within the ion source are at pressures generally used for mass spectroscopy. The pressure must be sufficiently low to allow electrons and ions to freely move within the apparatus as in ionization chamber 103A, lens chamber 177, and the space surrounding the sample. By way of illustration, conditions conducive to the art of gas spectroscopy are generally about 1 mTorr. Pressures of that order of magnitude are conducive to formation of positive ions in ionization chamber 103A. Pressures in the sample area 201 and lens chamber 177 are somewhat lower by an order of magnitude and can range down to $10^{-5}$ Torr. Preferred gases are the nobel gases (e.g. argon) and the like generally used for sputtering processes.

Metals used for the shield 101, anode means 103, grids 162, 182, repeller 195, focusing rings 141, 142, wiring and other like components are preferably nonmagnetic. Examples of suitable metals include, tantalum, copper, stainless steel and the like. Wires are preferably covered with Teflon® insulation although other insulations providing good service in the environment encountered are acceptable. The term connector as used herein refers to wiring, lead-ins and necessary connectors in general that are needed for connection of an active electrical unit (e.g., anode 103, focusing means 150) to an outside source of electrical power.

Voltage between anode 103 and cathode 120 should typically range from 30 to 80 volts with 40 to 45 volts preferred. These voltages will give maximum ion production. The anode 103 will typically be 100–1000 volts with respect to ground but preferably about 500 volts. Extraction grid 131 floats electrically and is insulated while extraction grid 133 is at ground potential.

At the ionizer means 190, shield 191 is at the same potential as the inner anode wall 105. The voltage from filament 192 to tube 172 is about 20 to 100 volts with about 30 volts preferred. The repeller 195 is about 20 volts to 60 volts more negative than the filament 192. This causes the repeller 195 to repel the electrons from the filament 192 through grid 197 into lens chamber 177. Repeller 195 also shields the electrons from inner anode wall 105. The grid 197 is at the same potential as the tube 172 and thus also attracts electrons.

Typical voltages for repelling ions at the entrance grid 162 are about 20 to 150 volts with about 40 volts preferred. The voltages will be positive with respect to ground when repelling positive ions and the opposite for negative ions. These repeller voltages prevent the selected ions from entering the lens chamber 177 and moving to the mass spectrometer 203.

In order to attract ions down the central lens means 170 toward a mass spectrometer 203, a voltage opposite to that of the desired ion is applied to the exit grid 182. This voltage is typically about 8 to 30 volts with respect to ground. Positive ions entering tube 172 from the sample or positive ions formed by the ionizer means 190 are attracted down the tube.

Appropriate voltages at the tube 172 serve to minimize ion loss at the tube walls 172. Thus when positive ions are to be measured the tube 172 is about 4 to 12 volts more positive than ground or preferably about 5 to 6 volts. If negative ions are involved the magnitude of the voltages are the same but polarity is reversed.

When positive ions are involved the exit grid 182 should always be about 2 to 20 volts more negative then the tube 172 and more positive for negative ions.

Figure 7:
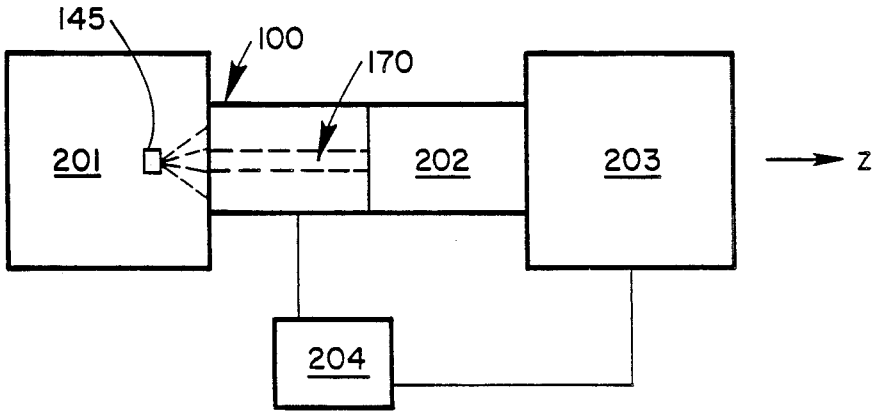
FIG. 7 depicts an embodiment incorporating the ion source of the present invention.

FIG. 7 illustrates generally how the ion source 100 of the invention relates to devices with which it interacts. Sample holder and sputter chamber 201 is attached to the ion source 100 so as to discharge ions toward the sample 145. Neutrals and ions are discharged toward the ion source and processed for analysis by the ion source 100 as described herein. Focus means 202 may be inserted between the ion source 100 and the mass spectrometer 203. Control means 204 is used to control the ion source 100 and mass spectrometer 203.

Coaxially disposed on the center line of FIG. 1, within the housing 110 and magnet 102 is anode 103 that with its walls 104, 105, 106 forms an annular ionization chamber or space 103A that is bounded at its output end by extraction means 130. Wall 105 forms a tubular region within which the lens means 170 is disposed.

Gas molecules are admitted to the ionization chamber 103A at appropriate pressure from a gas source (not shown) through gas pipe 174. These gas molecules are ionized by electrons produced at filament 125. Electrons produced by filament 125 are attracted toward the anode 103. As the electrons travel toward the anode 103 they are affected by the magnetic field from magnet 102 which causes them to travel in spiral paths within ionization chamber 103A. The spiral paths increase the likelihood of interaction between the electrons and gas atoms to produce positive ions.

As the number of positive ions increases they diffuse throughout the chamber and are maintained in the chamber by floating grid 131. Grid 133 which is at ground potential serves to attract the ions from the chamber and accelerate them toward a sample 145 mounted in the sample chamber 201. Grids 131, 133 are curved and have holes oriented toward the sample 145 so as to direct the positive ions toward sample 145. This serves to prefocus the ions. Fine focusing is achieved by focusing means 140 that includes an inner focusing ring 141 and outer focusing ring 142. The focusing rings 141, 142 focus by electrostatic action as the ions pass between the rings along paths 148.

As the positive ions impinge on the sample, other positive ions, negative ions and neutral atoms (neutrals) are removed from the sample 145 at the focus 146. These ions and neutrals travel in many directions. Some of the ions and neutrals travel toward the lens means 170 and can be processed if needed and measured by a mass spectrometer 203 located beyond the ion source 100.

Ions and neutrals can all be measured with the device because of the unique characteristics of the lens means 170. First, appropriate selection of polarity at the entrance grid 162 can remove one set of ions allowing the remaining ions to be measured after they pass through the lens. For example, an appropriate positive voltage at entrance grid 162 will repel positive ions allowing only negative ions to be measured. Secondly, neutrals can be measured. This can be done by first repelling one ionic species at the entrance grid 162 and obtaining a reading. Then the neutrals are subjected to ionization within the lens chamber 177 by ionization means 190. Thereafter another measurement is taken at the mass spectrometer with the difference attributable to the neutrals.

Ionization means 190 achieves its effect by producing electrons that spiral out of grating 197 into the lens chamber 177 and interact with neutrals to either produce negative ions or positive ions. The polarity of the ions produced depends on the characteristics of the neutral atom or molecule and the energy of the electron interacting with the neutral. This energy can easily be adjusted by those skilled in the art.

Positive and negative ions that enter the lens chamber 177 are accelerated by exit grid 182 toward the mass spectrometer 203 along the Z axis. Neutrals that have been ionized by the ionization means 190 similarly are attracted to the exit grid 182.

The ion source 100 is useful in analyzing a sample that has been exposed to a corrosive atmosphere. The sample is placed in sample chamber 201. The sample can be analyzed in depth profile by analyzing the sputtered material that is removed from the surface. This allows a sample to be characterized at the surface down to the substrate. The device of the invention performs both the sputtering operation (material removal) and analysis of the removed material simultaneously.

The preferred embodiment of this invention when measuring neutral atoms or molecules is the mode which provides the highest mass spectrometric sensitivity. In this embodiment entrance grid 162 of entrance means 160 from FIG. 1 is absent. The purpose of the entrance grid 162 is to repel high voltage ions during operation as a sputtered neutrals instrument. Removal of ions rather than being performed by a repulsion grid is performed at the detector end of the mass spectrometer by utilization of a Daly mirror detector [N. R. Daly, A. McCormick, R. E. Powell, Review of Scientific Instruments, 39, (1968) 1163]. A more detailed account of application of this detector has been presented by W. O. Hofer and F. Thum, Nuclear Instruments and Methods, 149, 535 (1978) and is well-known by those skilled in the art.

The sensitivity and signal to noise ratio are at the maximum attainable level when this detector is employed with a quadruple mass spectrometer of conventional design, but operated with a controlled floating potential on the quadruple rods. This potential is supplied by an auxiliary 0 to 100 volt DC power supply. Although the sensitivity is at a maximum, one feature is lost in utilizing the Daly mirror detector, and that is that negative ions cannot be detected with the Daly detector operating in the preferred mode. Neutrals are often preferentially detected over ions from the sample 145 since neutrals are more representative of the sample.

With reference to FIGS. 1 and 5, in a further embodiment where neutrals are produced at the sample 145 and the ionization of neutrals is to be enhanced, two holes 173 are disposed between ionization chamber 103A and lens chamber 177 in the central lens means 170. Two up to 2 mm diameter holes in the ceramic allow a small amount of the gas supply added to the ionization chamber 103A to enter the lens chamber 177. For cases where maximum sensitivity is necessary, additional ionization can occur by charge exchange with argon ions generated in the cylindrical lens. The holes are variable in size depending on the pumping ability of the mass spectrometer. The two holes 173 do not pass enough gas into the cylindrical lens to impair operation of the mass spectrometer because of degradation of vacuum conditions. For those cases where the primary purpose is to examine negative ions then the other embodiments not using the holes 173 are preferred.

If negative and positive ions need to be detected, then in an alternative embodiment the entrance grid 161 is utilized for most favorable signal to noise operations. A most favored operation for positive ions applies a voltage pulse to the entrance grid 162. This pulse is generated by a commercial pulse generator (control 204) and its signal is fed to the entrance grid 162 and also to a lock-in amplifier (control 204) of commercial design. The other channel of the lock-in amplifier receives the output of the electron multiplier detector of the mass spectrometer. This procedure allows energy discrimination and also improves the signal to noise ratio. Negative ions can be detected by reversing the potentials of the entrance grid 162 and central tube 172. Negative ions can be formed from neutrals in the cases where electron capture is the favored mode of ionization (e.g. $Cl_2$, $CCl_4$). By suitable choice of filament 192 and repeller 195 potentials, very low energy electrons can be produced. Such low energy electrons are the favored type for electron capture ionization.

A general overall description of the apparatus is a housing 110 oriented about a central axis, Z; magnet means 102 cooperatively disposed within the housing 110 for producing a magnetic field along the Z axis direction; anode means 103 radially disposed within the housing 110 and within the magnetic field of the magnet means 102 that defines an annular ionization chamber 103A having an open annular space and further forming a central tubular space about the Z axis; cathode means 120 cooperatively disposed at the anode means 103 and within the annular ionization chamber 103A; extraction means 130 cooperatively disposed within the housing 110 so as to form a boundary of the ionization chamber 103A; annular focusing means 140 disposed externally to the extraction means 130 for focusing ions emerging therefrom; neutralizing means 150 cooperatively disposed with the focusing means 140; lens means 170 cooperatively disposed about the central axis Z in the central tubular space formed by the anode 103 and adapted to accept ions and neutrals emanating from a sample 145; entrance grid means 160 disposed at the sample end of the lens means 170; second ionizing means 190 disposed along the length of the lens means 170; exit means 180 for directing ions toward a measurement instrument 203; and input gas means 174 cooperatively disposed with the housing and anode means so as to supply gas to the ionization chamber. A shield 101 disposed external to the housing 110 for electrically shielding the apparatus is preferred.

Another alternative embodiment of the invention involves the passive monitoring of an ongoing sputtering process. In this embodiment the positive ion producing portion of the device is not needed. In this embodiment only ions and neutrals given off during the sputter application process are used. Ions and neutrals that enter the device at entrance means 160 are then similarly processed as if they had been produced by positive ions from the ion source 100. This allows the ongoing monitoring of both neutrals and ions during a sputtering process.

The entire source can be "floated" at a high positive potential of two or more thousand volts and then the source can be used in conjunction with a magnetic sector direction focusing mass spectrometer. The source can be used directly with the mass spectrometer, or an electrostatic sector energy filter comprised of a parallel arrangement of plates, cylinders, or spheres or sections thereof which utilize an electric field gradient to allow passage of ions of only a narrow range of energies. Such spectrometers are well-known within the art as double focusing mass spectrometers.

An additional application of significant potential mates the source of a Time-of-Flight mass spectrometer. The Time-of-Flight utilizes a pulse of short duration but of a high repetition rate to draw ions into a flight tube where all ions of a given pulse receive the same electrical energy. Since the masses of the ions can vary, so do their velocities. It is this velocity difference the Time-of-Flight measures to determine the mass of the ion. Since the ion source operates at ground potential, there is no need to float the ion source as is required for the magnetic sector spectrometer. Mass resolution may be enhanced in the Time-of-Flight by including an electrostatic sector either alone or in combination with a pulsed grid or a pulse applied to the sector potential itself. A spectrometer system of great potential would consist of the coaxial reentrant source, an electrostatic section capable of pulsed operation and a Time-of-Flight mass spectrometer utilizing the reflection principle of B. A. Mamyrin, V. I. Karater, D. V. Shmikk, V. A. Zagulin, Soviet Physics JETP, 37 (1973) 45.

We claim:

1. An improved ion source for characterization of a surface of a sample comprising:

a. a housing;

b. an annular magnet cooperatively disposed within the housing, to produce a magnetic field along the direction of a central axis through the housing;

c. means for generating and containing ions that is cooperatively disposed within the annular magnet;

d. extraction means disposed adjacent to the generation and containment means for moving generated and contained ions toward a sample to be examined;

e. annular focusing means adjacent to the extraction means for focusing generated ions;

f. neutralizing means disposed cooperatively with the focusing means;

g. tubular central lens means centrally disposed to the ion generating and containment means, having an entrance and an exit end;

h. entrance means cooperatively disposed at the entrance one end of central lens for accepting ions and neutrals;

i. exit means cooperatively disposed at another end of the central lens for attracting ions toward a measurement device;

j. ionization means cooperatively disposed on the central lens means; and k. input gas means cooperatively disposed with the housing and anode means so as to supply gas to the ionization chamber.

2. The improved ion source of claim 1, further comprising: A shield disposed external to the housing for electrically shielding the improved ion source.

3. An apparatus for characterization of a surface of a sample comprising:

a. a housing oriented about a central axis, Z;

b. magnet means cooperatively disposed within the housing for producing a magnetic field along the Z axis direction;

c. anode means radially disposed within the housing and within the magnetic field of the magnet means that defines an annular ionization chamber having an open annular space and further forming a central tubular space about the Z axis;

d. cathode means cooperatively disposed at the anode means and within the annular ionization chamber;

e. extraction means cooperatively disposed within the housing so as to form a boundary of the ionization chamber;

f. annular focusing means disposed externally to the extraction means for focusing ions emerging therefrom;

g. neutralizing means cooperatively disposed with the focusing means;

h. lens means cooperatively disposed about the central Z axis in the central tubular space formed by the anode and adapted to accept ions and neutrals emanating from a sample;

i. entrance grid means disposed at the sample end of the lens means;

j. second ionizing means disposed along the length of the lens means;

k. exit means for directing ions toward a measurement instrument; and l. input gas means cooperatively disposed with the housing and anode means so as to supply gas to the ionization chamber.

4. The apparatus of claim 3, further comprising: A shield disposed external to the housing for electrically shielding the apparatus.

* * * * *